33-241 SR
11/17/87 XR 4,707,772

United States Patent [19]

Jimenez et al.

[11] Patent Number: 4,707,772

[45] Date of Patent: Nov. 17, 1987

[54] FIREARM SIGHT AND FLASHLIGHT MOUNTING SYSTEM

[76] Inventors: Ivan Jimenez; Irving N. Rubin, both of 5555 Treadwell, Wayne, Mich. 48184

[21] Appl. No.: 921,331

[22] Filed: Oct. 21, 1986

[51] Int. Cl.[4] ..... F41G 1/34

[52] U.S. Cl. ..... 362/110; 33/241; 33/245; 362/419; 362/191

[58] Field of Search ..... 362/110, 191, 251, 800, 362/188, 419, 427; 33/245, 241, 242, 261, 243, 244

[56] References Cited

U.S. PATENT DOCUMENTS 1,579,671 4/1926 Staats-Oels ..... 362/110
3,682,552 8/1972 Hartman ..... 33/245
3,974,585 8/1976 Dunham ..... 33/241
4,429,468 2/1984 Jimenez et al. ..... 33/245

FOREIGN PATENT DOCUMENTS 22939 of 1913 United Kingdom ..... 362/110

*Primary Examiner*—James C. Yeung
*Attorney, Agent, or Firm*—Rhodes and Boller

[57] ABSTRACT

A system for mounting a flashlight on a firearm so that the mounting of the flashlight does not interfere with the sighting system, be it telescopic, non-telescopic, or a combination of the two. Various embodiments of mounts are disclosed for these several types of sightings systems. One embodiment for a telescope sight system comprises a separable mounting of the flashlight on the firearm which does not affect the mounting of the telescope sight.

24 Claims, 6 Drawing Figures

FIREARM SIGHT AND FLASHLIGHT MOUNTING SYSTEM

BACKGROUND AND SUMMARY OF THE INVENTION

This invention relates generally to firearms, and it is particularly concerned with a sight and flashlight mounting system for firearms.

At certain times it is desirable to utilize a flashlight in conjunction with a firearm. For example, where night hunting with firearms is permitted, flashlights are used to spot game. Other examples are in connection with pest control and law enforcement activities.

It is advantageous to mount a flashlight on a firearm with a beam of light emanating in a direction parallel with the direction in which the firearm is aimed. For such a mounting to be acceptable however, it should not impair the use of the particular sighting system on the particular firearm.

Known sighting systems are of three general types: non-telescopic, telescopic, and a combination of the two. Examples of non-telescopic sighting systems are conventional iron sights or peep sights. Sometimes sighting takes place simply along the barrel without the use of any sighting devices at all. In the base of a shotgun there may be merely a bead at the end of the barrel. A telescopic sight system contains a telescope sight mounted on the firearm by mounts. A combination system makes provision for both telescopic and non-telescopic sighting.

For a flashlight to be utilized successfully on firearms, its mounting must not impair the existing sighting system whether it be telescopic, non-telescopic, or a combination of the two.

The present invention is directed to a combined sighting and flashlight mount system which applies to non-telescopic sights alone, telescope sights alone, and a combination containing both telescopic and non-telescopic sights.

A telescope sight is typically mounted on a firearm parallel with the barrel by a pair of spaced apart mounts. One type of mount is called a "see-through" type which provides for both non-telescopic sighting by looking through the "see-throughs" and telescopic sighting by looking through the telescope. A telescope sight mount requires rigidity so that once sighted properly, the telescope sight will not come loose during the typical use of the firearm.

The present invention takes this factor into account by providing the feature wherein a flashlight removably mounts on a telescope sight mount without impairing the accuracy of the sight alignment of the telescope sight. Moreover, flashlight mounting and removal are accomplished in a quick and facile manner through the provision of certain unique features. When mounted, the flashlight is rigidly held in place and will itself not come loose during expected use of the firearm.

The invention also takes into account the recognition that there are many rifles with telescope sights already in use so that according to a further aspect, it is unnecessary for owners of such existing telescope sight firearms to completely replace the mounting systems which they presently have. According to this aspect of the invention a kit is provided for a flashlight mount system including mounts for holding the flashlight and adapters for adapting the flashlight mounts to the existing telescope mounts. In the disclosed embodiment only the top clamps which are utilized to clamp the telescope sights in existing telescope sight mounts are replaced so that the base portions of the existing mounts can continue to be used. Of course in the case of a new firearm, or an existing firearm, lacking a telescope sight, a complete new mounting system for both telescope and flashlight is provided.

With the present invention, the user of a firearm can conveniently mount a flashlight when usage thereof is desired and likewise remove it when usage is not desired. The mounting for the flashlight is rugged and serves to maintain accuracy of the flashlight along a direction which is parallel with the barrel. In the preferred embodiment of the invention the flashlight mounts atop the sighting system.

A still further aspect is that the configurations of the invention do not interfere with the means of adjustment of the telescope sight. The invention can be utilized with various types of firearms including pistols, rifles and shotguns. Indeed, the system can be used with firearms or simulated firearms which lack the ability to fire projectiles.

Although the particular brand of flashlight which is utilized is not critical, the types sold under the brand name "Mag Lite" and the brand name "Mini Mag Lite" are well suited because of their ability to deliver a focusable, well-concentrated beam of intense light at an appreciable distance.

The foregoing features, advantages and benefits of the invention, along with additional ones, will be seen in the ensuing description and claims which should be considered in conjunction with the accompanying drawings. The drawings disclose a preferred embodiment of the invention according to the best mode contemplated at the present time in carrying out the invention.

DESCRIPTION OF THE PREFERRED EMBODIMENT

Figure 1:
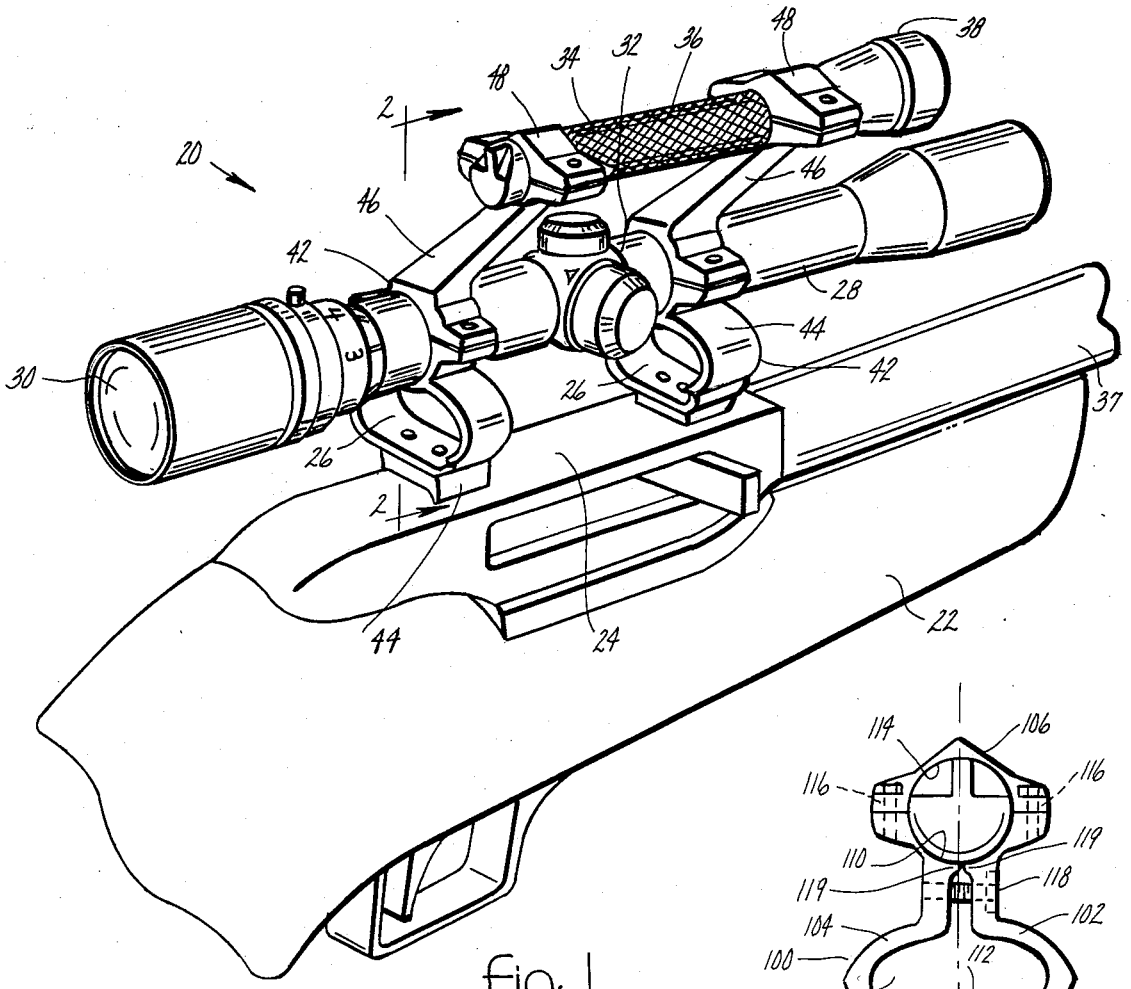
FIG. 1 is a fragmentary perspective view from the right rear of a mounting system embodying principles of the invention as applied to a firearm.
Figure 2:
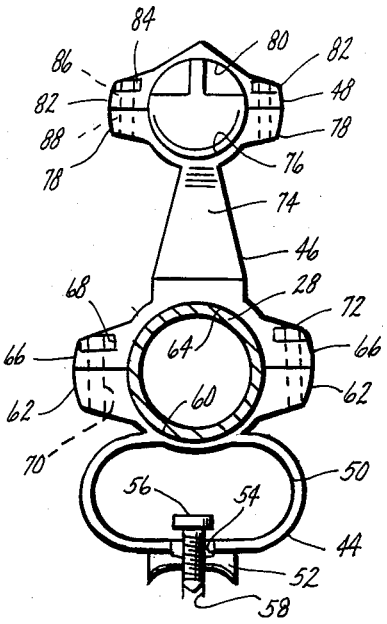
FIG. 2 is a transverse cross sectional view taken in the direction of arrows 2—2 in FIG. 1 on a slightly enlarged scale.

FIGS. 1 and 2 illustrate a first embodiment of sight and flashlight mounting system 20 mounted on a firearm 22. The illustrated firearm 22 is a rifle, by way of example, and system 20 attaches to the top of the rifle's receiver 24.

The illustrated system is a combination one, comprising a see-through 26 for non-telescopic sighting and a telescope sight 28 for telescopic sighting.

The telescope sight 28 is conventional and includes an eye-piece end 30 and an adjusting mechanism, 32 generally, via which internal cross hairs, an internal reticle, or other indicia contained within the sight, is adjusted for purposes of sighting-in the firearm.

The invention provides for the mounting of a flashlight 34, and the illustrated flashlight is a Mini Mag Lite type which has a cylindrical body 36 arranged parallel to the barrel 37 of firearm 22 and to the telescope sight 28. Flashlight 34 has a head 38 at one end of body 36 via which light is emitted in a direction lengthwise of the flashlight, and the flashlight is so mounted on the firearm as to be aimed in the same direction as the firearm. The flashlight includes an on/off switch accessible from the exterior for turning the flashlight on and off.

Mounting system 20 comprises two identical sets 42 of mounts, one forward, the other rearward. Excluding fastening screws which are utilized to hold the several parts of each set in assembled relationship, each set 42 comprises three separate mount members. They are a lower member 44, an intermediate member 46, and an upper member 48. Lower member 44 is proximal to the firearm and intermediate member 46 and upper member 48 are successively more distal.

Each lower member 44 comprises a see-through ring 50 providing a capability for non-telescopic sighting. Each member 44 also has a base 52 for mounting on firearm 22 in a secure and rigid manner. In the illustrated embodiment, attachment is accomplished by a pair of counterbored holes 54 through base 52. The shanks of screws 56 are passed through holes 54 and tightened into tapped holes 58 in the top of receiver 24. The latter holes 58 are either drilled and tapped at the occasion of installation of the mounting system on a firearm or else they may be holes which are pre-existing in the firearm as sold by the firearm manufacturer.

Member 44 further includes a generally semi-circular shaped, upwardly facing receptacle portion 60 atop see-through ring 50. Receptacle portion 60 is configured with a radius to permit the close-fitting reception of the circular cylindrical body of telescope sight 28. Projections, or enlargements, 62 are also disposed at opposite sides of the semi-circular receptacle portion.

Intermediate member 46 comprises a lower, downwardly facing, generally semi-circular clamping portion 64 which is configured to fit closely onto the body of telescope sight 28. Projections 66 are provided at opposite sides of the clamping portion 64 and both projections 62 and 66 have flat surfaces confronting each other. Projections 66 comprise counterbored holes 68 which align with tapped holes 70 in projections 62. The shanks of headed screws 72 are passed through holes 68 and tightened into holes 70 so that the telescope sight is thereby securely clamped between members 44 and 46 and thereby rigidly mounted on the firearm.

The illustrated embodiment of mounting system 20 further comprises the intermediate members 46 having intermediate portions 74 which incline upwardly and forwardly from clamping portions 64. At its upper end, each member 46 comprises an upwardly facing generally semi-circular receptacle portion 76. Projections 78 lie to opposite sides of each receptacle portion 76. The body 36 of flashlight 34 is received in the receptacle portions 76.

The upper members 48 have downwardly facing generally semi-circular clamping portions 80 with projections 82 on opposite sides. The projections 78 and 82 are configured with flat surfaces confronting each other. Attachment of member 48 to member 46 to clamp the flashlight is accomplished by the use of screws 84 in an analogous manner to the clamping of the telescope sight between members 44 and 46. The screws 84 pass through counterbored holes 86 in projections 82 and are tightened into tapped holes 88 in projections 78.

The illustrated configuration of the invention results in the flashlight and the telescope sight being disposed parallel with the barrel of the rifle and with the head of the flashlight being so supported that its beam is not obstructed by the rifle or the telescope sight. Likewise the flashlight in no way interfers with the sighting system, and the telescope sight adjusting mechanism 32 is accessible without the need to remove the flashlight. Therefore once the telescope sight and flashlight have been mounted, the rifle, telescope sight and the non-telescopic sight can be used in conventional manner. The on/off switch for the flashlight is located at a particular angular location about its axis by the particular angular orienting of the flashlight in its mounting at the time of installation.

Figure 3:
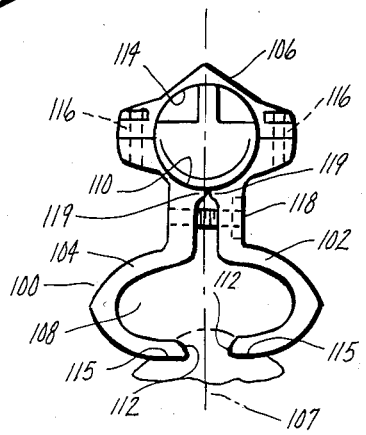
FIG. 3 is a view similar to FIG. 2 illustrating a modified form as applied to another type of firearm.

FIG. 3 illustrates another embodiment for a mount 100 which can be used in a non-telescopic system. In certain respects, mount 100 is similar to the telescope sight mount illustrated in our U.S. Pat. No. 4,429,468 dated Feb. 7, 1984. With the exception of clamping and adjusting screws, mount 100 comprises three mount members 102, 104, 106. The two mount members 102, 104 are symmetrical about an imaginary plane 107 passing through the telescope and barrel axes. Each member 102, 104 defines one half of a see-through ring 108 and one half of a generally semi-circular upwardly facing receptacle portion 110. See-through ring 108, unlike see-through ring 50 in FIG. 2, is not a full ring, but rather has free ends 112 via which attachment is made to the firearm.

Member 106 has a downwardly facing generally semi-circular clamping portion 114 which is cooperatively arranged with the upwardly facing receptacle portion 110 to clamp the flashlight body in the same manner as described for the embodiment of FIGS. 1 and 2, i.e. by use of screws 116 associated with confronting projections at the sides of the clamping and receptacle portions.

Two adjusting screws 118 extend transversely between members 102, 104 above the see-through. The heads of screws 118 seat in counterbored holes in member 102. The shanks of the screws extend into tapped holes in the opposite member 104. Projections 119 abut each other to provide a pivot point for the free ends 112 of the see-through. By adjusting the degree of tightening of screws 118, it is possible to control the distance between the free ends 112 of the see-through so that the see-through can thereby be releasably clamped onto grooves 115 which extend parallel along the length of the firearm. The typical installation will use two sets of mounts 100 spaced apart along the length of the firearm whereby a secure and rigid mounting is attained.

Figure 4:
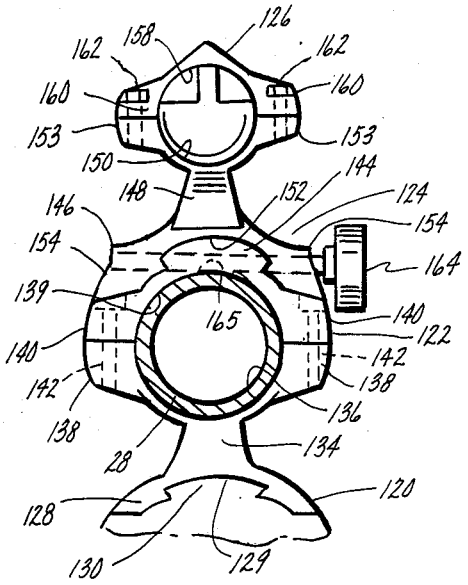
FIG. 4 is a view similar to FIG. 2 illustrating a further modified form as applied to still another type of firearm.

FIG. 4 illustrates another embodiment which represents a telescopic sight/flashlight configuration. This embodiment is in certain respects similar to the embodiment of FIGS. 1 and 2, but it lacks a see-through. Apart from the various clamping and attaching screws, the embodiment comprises a lower member 120, a two-member intermediate portion consisting of members 122 and 124 and an upper member 126. These constitute one set, and there are two such sets used per firearm.

Member 120 comprises a base portion 128 having a dovetail slot 129 via which it mounts onto a corresponding dovetail projection 130 which may be an integral part of the firearm or a separate member attached to the firearm. Member 120 further includes an upright 134 with a generally semicircular, upwardly facing receptacle portion 136 thereon. The receptacle portion 136 includes projections 138 at opposite sides.

Member 122 comprises a lower, downwardly facing, generally semi-circular receptacle portion 139 with projections 140 at the sides. Portion 139 confronts receptacle portion 136 for the purpose of clamping in a secure manner the telescope sight body between the two members 120 and 122. The clamping arrangement is the same as that described in the embodiment of FIGS. 1 and 2 utilizing counterbored holes in projections 140, tapped holes in the projections 138, and screws 142 which are tightened to secure the two together in clamping of the telescope sight. Member 122 is further provided with an upper, centrally located dovetail projection 144.

Member 124 comprises a lower portion 146, an intermediate upright portion 148 and an upper receptacle portion 150. The lower portion 146 comprises a downwardly facing, centrally located dovetail slot 152 which is complementary with dovetail projection 144. It also includes projections 154 on opposite sides which are complementary to the top of member 122. Receptacle portion 150 is supported in spaced relationship to lower portion 146 by the intermediate upright portion 148. Receptacle 150 is upwardly facing, and of generally semi-circular shape with projections 153 at opposite sides.

Upper member 126 comprises a downwardly facing generally semi-circular receptacle portion 158 with projections 160 on opposite sides. Member 126 is cooperatively associated with member 124 to securely clamp the flashlight between them in the same manner as was described in connection with FIG. 2 with screws 162 being used to secure the two parts together.

The members 124, 126 clamped onto the flashlight form a removable assembly which removably mounts on the telescope sight by means of the dovetail connections 144, 152. In order to separate the two members 122, 124 from each other, the assembly is moved axially parallel to the length of the barrel until members 124 axially clear members 122. Reattachment is affected in the opposite manner.

In order to lock the two members 122, 124 together when the dovetail connection is made, a thumb screw 164 is attached to member 124. Screw 164 is arranged transversely to the axial direction and it spans the dovetail slot 152, extending between projections 154. Screw 164 has a head to one side which bears against the corresponding projection 154, and the screw's shank extends to thread into a threaded hole in the opposite projection 154. A transverse slot 165 (FIG. 1) is provided axially centrally in the upper part of member 122 so as to provide a clearance for the screw 164. With the slot provided in spaced relationship to both axial ends of the dovetail projection 144, it is necessary to unthread the screw 164 from its threaded engagement with the member 124 so that it does not prohibit the axial sliding of the member 124 onto and off of the member 122. When the holes in member 124 for the screw 164 are aligned with slot 165 in the member 122, the screw can be inserted and tightened. The tightening of the screw 164 serves to tightly clamp the member 124 onto the member 122 in a secure and rigid manner. Removal and re-mounting of the flashlight does not affect the adjustment of the telescope sight because the telescope sight remains securely mounted on the firearm.

Figure 5:
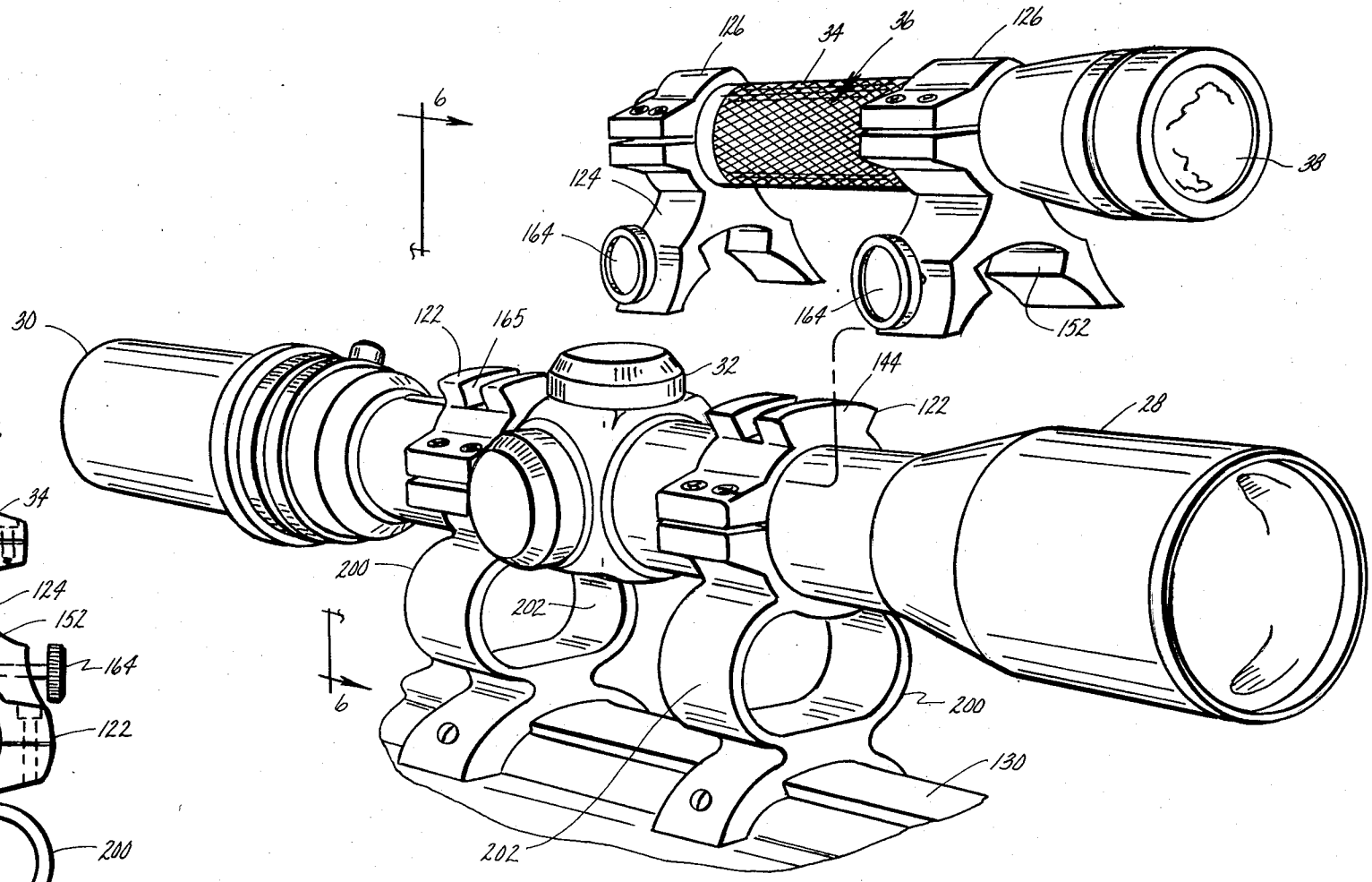
FIG. 5 is a fragmentary perspective view similar to FIG. 1 illustrating another embodiment of the invention in an exploded form for purposes of illustration.
Figure 6:
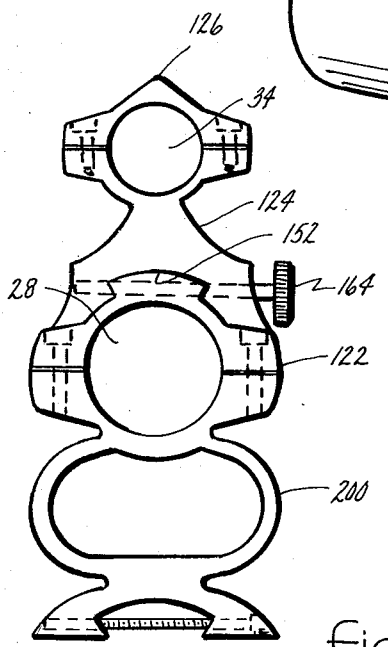
FIG. 6 is a cross sectional view taken generally in the direction of arrow 6—6 in FIG. 5 but showing the several parts in assembled relationship.

FIGS. 5 and 6 portray a further embodiment of the invention which is very similar to the embodiment of FIG. 4 and like parts are identified by like reference numerals. In this embodiment the members 126, 124, and 122 are the same. The member 120 is replaced by a new member 200 which is similar except that instead of the upright 134 there is a see-through ring 202 instead. Thus the embodiment of FIGS. 5 and 6 has the capability for use with a combined sighting system having both a telescopic sight and a non-telescopic sight. FIG. 5 also portrays more detail of many of the features of FIG. 4, and it also portrays graphically how the flashlight removably mounts on the telescopic sight.

In all embodiments of the invention, the flashlight is mounted on the firearm in a secure and stable manner. The embodiments of FIGS. 4, 5, and 6 are especially advantageous because the flashlight can be removed from the telescope sight while the telescope sight remains securely mounted on the firearm. In all embodiments, the mounting from the flashlight does not affect the sighting systems, be they telescopic or non-telescopic, and likewise the sighting systems do not interfere with the beam of light emitted by the flashlight or with the convenient operation of turning the flashlight on and off.

The mount members which have been described may be fabricated by conventional fabrication technique. For example the members can be formed by extrusion processes to the desired cross-sectional shapes such as those portrayed in FIGS. 2, 3, and 4, with the individual mount members being cut from the extrusions. For example, aluminum and/or aluminum alloys are suitable materials since they can be extruded, and they possess rigidity and machinability. The typical practice is to drill and tap whatever holes and counterbores are required after the members have been cut from the extrusions and in general, it will be unnecessary to perform extra operations except for the possibility of painting the mounts which is typically done with a dark, non-reflective paint.

The screw heads are typically provided with a polygonally shaped socket, a hex for example, which is actuated by a tool of the same complementary shape for tightening and loosening.

A further aspect of the invention is that it is adaptable to firearms which already have telescope sight mounts. For example, telescope sight mounts typically comprise lower mounting members such as the lower members portrayed in FIGS. 2 and 4, for example. The telescope sight is clamped in place by an upper member similar to the upper clamping member illustrated in FIGS. 2 and 4 to clamp the telescope sight but of the appropriate size. According to this further aspect of the invention, the invention can be embodied in an adapter kit which comprises, in the case of the embodiment of FIG. 2, the mount members 46 and 48. The existing telescope clamp is removed and may be discarded if desired. It is replaced by the member 46 to clamp the telescope and the flashlight is of course mounted by the two members 46 and 48. Likewise in the case of the embodiment of FIG. 4, such a kit would contain the members 122, 124, and 126.

Of course in the case of a new firearm or one which did not have an existing telescope mount, complete sets of mounts would be used.

While a preferred embodiment of the invention has been disclosed, it will be appreciated the principles are applicable to other embodiments. For example in FIG. 3, the two members 100, 102 could extend essentially straight from receptacle 110 to ends 112, rather than forming the large see-through 108.

What is claimed is:

1. In combination with a firearm having a barrel, two cylindrical devices in the form of a flashlight and a telescope sight respectively, and means for mounting said two devices on the firearm comprising a lower member means, means for attaching the lower member means to the firearm, said lower member means comprising means forming an upwardly facing receptacle means receiving one of said cylindrical devices, intermediate member means having a downwardly facing clamping means cooperatively associated with the upwardly facing receptacle means of the lower member means for clamping between them said one cylindrical device, said intermediate member means having an upwardly facing receptacle means spaced above said downwardly facing clamping means, said second-mentioned receptacle means receiving the other of said cylindrical devices and upper member means comprising means cooperatively associated with said second-mentioned receptacle means for clamping the other of said cylindrical devices.

2. The combination set forth in claim 1 in which said one cylindrical device is the telescope sight and the other cylindrical device is the flashlight.

3. The combination set forth in claim 1 in which said lower member means comprises means defining a see-through through which the firearm can be non-telescopically sighted.

4. The combination set forth in claim 1 in which said lower member means comprises a post extending uprightly to the first-mentioned receptacle means.

5. The combination set forth in claim 1 in which said lower member means comprises a one-piece member containing the first-mentioned receptacle means.

6. The combination set forth in claim 1 in which said intermediate member means comprises a one-piece member containing both the second-mentioned rceptacle means and the first-mentioned clamping means.

7. The combination set forth in claim 6 in which said one-piece member includes a post extending between the second-mentioned receptacle means and the first-mentioned clamping means.

8. The combination set forth in claim 7 in which said post inclines upwardly and forwardly in relation to the barrel of the firearm.

9. The combination set forth in claim 1 in which said intermediate member means comprises two intermediate members and means separably joining said two intermediate members with each other.

10. The combination set forth in claim 9 in which said means separably joining said two intermediate members with each other comprises a dovetail connection.

11. The combination set forth in claim 10 in which the dovetail connection comprises a slot and projection formed integrally in the two respective intermediate members.

12. The combination set forth in claim 11 including locking means for releasably locking the dovetail connection.

13. The combination set forth in claim 12 in which said locking means comprises a thumb screw arranged transversely to the axis of the dovetail connection.

14. The combination set forth in claim 9 in which said means separably joining said two intermediate members comprises means enabling the flashlight and the one of said two intermediate members which contains the second-mentioned receptacle to be removed as a unit from the other intermediate member while the latter remains in clamping engagement with the lower member means to hold the telescope sight.

15. A flashlight mounting system for mounting a flashlight onto a firearm having a pre-existing telescope sight mounted on the firearm by an upper and a lower mount member with the telescope sight parallel to the direction of the firearm's barrel, said mounting system comprising an intermediate member means in replacement of the upper mount member of the pre-existing telescope sight mount, said intermediate member means comprising a clamping portion which is cooperatively associable with the lower mount member of the pre-existing telescope sight mount for clamping of the telescope sight, said intermediate member means further including means defining receptacle means in spaced relation above the telescope sight, and means which is cooperatively arranged with respect to the intermediate member means so as to cooperatively associate with the receptacle means thereof for clamping of the flashlight.

16. A system as set forth in claim 15 in which said intermediate member means comprises a one-piece member containing both said clamping portion and said receptacle means.

17. A system as set forth in claim 15 in which said intermediate member means comprises two intermediate members separably mounted together, one of said members containing said clamping portion and the other containing said receptacle means.

18. A system as set forth in claim 17 in which the separable mounting comprises means providing for the flashlight and said other intermediate member to be removed as an assembly by displacing same axially of the telescope sight so as to cause separation between the two intermediate members.

19. A system as set forth in claim 17 including a locking means for releasably locking the separable mounting of the two members of said intermediate member means.

20. In combination with a firearm having a barrel, two cylindrical devices in the form of a flashlight and a telescope sight respectively, and means for mounting said two devices on the firearm comprising a proximal mount member means, means for attaching the proximal mount member means to the firearm, said proximal mount member means supporting one of said devices in spaced relation above the firearm, intermediate mount member means supported on said proximal mount member means, said intermediate mount member means comprising means spacing and supporting the other of said cylindrical devices above said one cylindrical device, means cooperating with said proximal mount member means in clamping said one device on said proximal mount member means, and means clamping said other device on said intermediate mount member means, and a separable connection in said intermediate mount member means constructed and arranged such that one portion of said intermediate mount member means can be removed from another portion of said intermediate mount member means while said other device remains clamped on said one portion of said intermediate mount member means and while said one device remains clamped on said proximal member means.

21. In combination with a firearm having a barrel, two cylindrical devices in the form of a flashlight and a telescope sight respectively, and means for mounting said two devices on the firearm comprising a proximal member means, means for attaching the proximal member means to the firearm, said proximal member means comprising means forming a receptacle means facing away from the barrel and receiving one of said cylindrical devices, intermediate member means having a clamping means cooperatively associated with the receptacle means of the proximal member means for clamping between them said one cylindrical device, said intermediate member means having its own receptacle means spaced above its clamping means, said second-mentioned receptacle means receiving the other of said cylindrical devices, and distal member means comprising means cooperatively associated with said second-mentioned receptacle means for clamping said other of said cylindrical devices.

22. The combination set forth in claim 21 in which said intermediate member means comprises a one-piece member containing both the second-mentioned receptacle means and the first-mentioned clamping means, said one-piece member includes a post extending between the second-mentioned receptacle means and the first-mentioned clamping means, and said post inclines forwardly at an acute angle in relation to the barrel of the firearm.

23. The combination set forth in claim 21 in which said intermediate member means comprises two intermediate members and means separably joining said two intermediate members with each other.

24. The combination set forth in claim 23 in which said means separably joining said two intermediate members comprises means enabling the flashlight and the one of said two intermediate members which contains the second-mentioned receptacle means to be removed as a unit from the other intermediate member while the latter remains in clamping engagement with the proximal member means to hold the telescope sight.

* * * * *